US006690765B1

(12) United States Patent
Miller

(10) Patent No.: US 6,690,765 B1
(45) Date of Patent: Feb. 10, 2004

(54) SLEEVE FOR A STATIONARY ANODE IN AN X-RAY TUBE

(75) Inventor: Robert Steven Miller, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/947,716

(22) Filed: Sep. 6, 2001

(51) Int. Cl.[7] ..... H01J 35/08
(52) U.S. Cl. ..... 378/124; 378/119
(58) Field of Search ..... 378/124, 119, 378/123, 204, 140, 142

(56) References Cited

U.S. PATENT DOCUMENTS 2,407,857 A * 9/1946 Verhoeff ..... 250/143
3,760,213 A * 9/1973 Buzzard ..... 313/39
4,196,367 A * 4/1980 Diemer et al. ..... 313/59
6,188,747 B1 * 2/2001 Geus et al. ..... 378/124

* cited by examiner

*Primary Examiner*—Edward J. Glick
*Assistant Examiner*—Irakli Kiknadze
(74) *Attorney, Agent, or Firm*—Workman Nydegger

(57) ABSTRACT

A sleeve or cover for preventing the production of secondary x-ray signal contamination from an analytical x-ray tube is disclosed. The x-ray tube includes an evacuated enclosure in which is disposed a cathode and anode. The sleeve or cover is useful in applications such as x-ray fluorescence spectroscopy for improving the spectral purity of the primary stream of x-rays produced by electron bombardment of the anode target surface by the cathode. In one embodiment, the sleeve is disposed about a portion of the anode substrate, and is comprised of beryllium. Electrons back-scattered from the target surface are attracted to the anode substrate and impact the beryllium sleeve, producing secondary x-rays that are not detected by spectroscopic detectors and are therefore not contaminating to the primary x-ray stream.

23 Claims, 4 Drawing Sheets

SLEEVE FOR A STATIONARY ANODE IN AN X-RAY TUBE

BACKGROUND OF THE INVENTION

1. The Field of the Invention

The present invention generally relates to x-ray tubes. More specifically, the present invention relates to an apparatus for reducing contaminating secondary x-ray emission from stationary anode x-ray tubes.

2. The Relevant Technology

X-ray producing devices are extremely valuable tools that are used in a wide variety of applications, both industrial and medical. Such equipment is commonly used in applications such as diagnostic and therapeutic radiology, semiconductor fabrication, joint analysis, and non-destructive materials testing. While used in a number of different applications, the basic operation of an x-ray tube is similar. In general, x-rays are produced when electrons are accelerated and impinged upon a material of a particular composition.

X-ray generating devices typically include an electron source, or cathode, and an anode disposed within an evacuated enclosure. The anode includes a target surface that is oriented to receive electrons emitted by the cathode. In operation, an electric current is applied to a filament portion of the cathode, which causes electrons to be emitted by thermionic emission. The electrons are then accelerated towards the target surface of the anode by applying a high voltage potential between the cathode and the anode. Upon striking the anode target surface, some of the resulting kinetic energy is released as electromagnetic radiation of very high frequency, i.e., x-rays.

The specific frequency or wavelength of the x-rays produced depends in large part on the type of material used to form the anode target surface. Anode target surface materials with high atomic numbers ("Z" numbers), such as tungsten, are typically employed. The x-rays ultimately exit the x-ray tube through a window in the x-ray tube, and interact in or on various material samples or patients. As is well known, the x-rays can be used for sample analysis procedures, therapeutic treatment, or in medical diagnostic applications.

One application for which x-ray tubes are well suited is referred to as x-ray fluorescence spectroscopy ("XRF"). XRF is typically used to determine the elemental composition of a selected material. An XRF instrument setup typically includes an analytical x-ray tube (AXT), a specimen to be analyzed, a collimator, a diffracting crystal, and an x-ray detector. To analyze the composition of the specimen, the x-ray tube is activated and x-rays are directed at the specimen. The interaction of the x-rays with the atoms in the specimen causes the atoms to emit, or fluoresce, a second group of excited x-rays having energies characteristic of the elements in the specimen. Once emitted by the sample, the fluoresced x-rays are dispersed into a spectrum by a diffracting crystal, and are then collimated towards a detector and associated instrumentation, which quantifies and correlates the results. The intensities of the various energy peaks in the spectrum are roughly proportional to the concentration of the corresponding elements that comprise the specimen. In this way, the elemental composition of a variety of materials may be ascertained.

Many x-ray tubes employ a rotary anode that rotates portions of its target surface into and out of the stream of electrons produced by the cathode. However, analytical x-ray tubes, such as those used for XRF applications, typically use a stationary anode. The stationary anode typically includes a substrate portion, comprised of copper or similar material, and a target surface comprised of rhodium, palladium, tungsten, or other suitable material. For an XRF procedure to yield superior results when assaying a specimen, it is highly desirable that the x-ray tube produce a stream of primary x-rays that is spectrally pure, i.e., the spectrum is comprised of the continuous spectrum and the characteristic peaks of the target material. This spectrally pure stream of primary x-rays is produced by those electrons that impact the target surface of the anode and produce x-rays having a characteristic wavelength corresponding to the material deposited on the target surface.

Unfortunately, many of the electrons that impact that target surface do not produce primary x-rays. Most of the kinetic energy that results from the impact is released in the form of heat. Also, a significant number of electrons simply rebound from the anode target surface and strike other non-target surfaces within the x-ray tube, such as the anode substrate or other components within the tube. These electrons are often referred to as "back-scatter" or secondary electrons. These back-scattered electrons retain a significant amount of their original kinetic energy after rebounding. As such, these secondary collisions with non-target surfaces can produce secondary or off-focus x-rays having a wavelength that is characteristic of the material impinged, such as copper. These secondary x-rays are emitted from the x-ray tube along with the primary x-rays created at the target surface of the stationary anode. In XRF spectroscopy, these secondary x-rays are considered an undesirable contamination of the primary x-ray stream because they interfere with the measurement of the fluorescing x-rays emanating from the specimen under analysis. In other words, an XRF detector may mistake a contaminating secondary x-ray having, for example, a characteristic copper wavelength produced by the copper anode substrate as having been produced by a fluorescing copper atom present in the specimen under analysis. Thus, to optimize the quality of the signal, it is critical to reduce or eliminate these secondary x-rays from the x-ray emissions of an x-ray tube.

Several attempts have been made to eliminate secondary x-ray contamination from primary x-ray emissions. One approach involves the process of chemically coating the anode substrate with the same material as is deposited on the target surface. This method has met with only limited success due to the difficulty in getting a sufficiently thick plating to adhere to the anode substrate. Moreover, during tube operation, the high temperatures present in the anode substrate often cause the coating to intermingle with the substrate material, leading to the eventual production of contaminating secondary x-rays.

Another approach has involved the use of a graphite layer to cover a portion of the anode substrate where back-scattered electrons typically impact. Though this approach reduces the amount of contaminating x-rays that are emitted, it gives rise to other problems. In particular, the approach results in serious outgassing and particle creation problems during tube operation because of differing thermal expansion rates between the graphite layer and the anode substrate, and because of the extensive machining and handling steps required for assembly and attachment of the graphite layer. Outgassing and particle creation within the evacuated environment of an x-ray tube are highly detrimental to its performance and operating lifetime A need therefore exists for a stationary x-ray tube that reduces or eliminates the production of secondary x-rays. This need is especially acute in x-ray tubes employed in XRF spectroscopy operations, which require spectrally pure x-ray signals. Further, any solution to enable the creation of spectrally pure x-ray streams should do so without creating ensuing problems, such as outgassing and particle creation that are detrimental to the operation of the tube.

SUMMARY OF THE INVENTION

Embodiments of the present invention have been developed in response to the current state of the art, and in particular, in response to these and other problems and needs that have not been fully or adequately solved by currently available x-ray tubes. In general, embodiments of the present invention are directed to a cover, or sleeve, that reduces or eliminates the emission of secondary x-ray contamination in stationary anode x-ray tubes. In addition, the sleeve is implemented in a manner so as to prevent other problems within the tube, such as contamination and outgassing. In preferred embodiments, the sleeve is sized and configured to cover a portion of a component disposed within the x-ray tube evacuated enclosure that is susceptible to being impinged by secondary or back-scattered electrons. For example, in one embodiment, the sleeve is affixed to a portion of the stationary anode substrate that is adjacent to the target surface. In particular, the sleeve is positioned so that it prevents errant electrons back-scattered from the target surface from impacting the anode substrate, thereby preventing the production of secondary x-rays. Instead, the back-scattered electrons that would otherwise impact the anode substrate impact the anode sleeve, and produce x-rays that are within a wavelength range that do not negatively impact the analysis being undertaken.

Preferred embodiments of the anode sleeve generally comprises a shape necessary to cover a portion of the outer surface of the anode substrate. For example, in one embodiment, the anode sleeve is formed in the shape of a hollow cylindrical body. The anode sleeve has a cylindrical length sufficient to cover those portions of the anode substrate that are susceptible to impact by back-scattered electrons. For example, in some applications, the anode sleeve covers a small portion of the anode substrate adjacent to the target surface. Alternatively, if the application dictates, the length of the sleeve may be greater so as to cover a greater portion of the anode substrate. The thickness of the anode sleeve wall(s) need only be thick enough to prevent penetration of electrons to the anode substrate material. The sleeve is preferably comprised of a material that does not create contaminating x-rays as detected by analysis instrumentation when impacted by electrons. For example, in a preferred embodiment, the anode sleeve comprises beryllium. Other suitable materials could be used depending on the functional requirements of the x-ray tube and the analysis being performed.

Embodiments of the present invention use the anode sleeve on a stationary anode in an x-ray tube having an end-window configuration. Alternative embodiments use the sleeve in x-ray tubes having a side-window configuration. Indeed, the anode sleeve of the present invention may be adapted in size and shape to fit a variety of anodes and types of x-ray tubes. Also, a sleeve or a cover could be fitted to other interior x-ray tube components to prevent secondary x-ray emissions from those components as well. An example of this would include a cathode shield comprising beryllium that is positioned so as to prevent secondary x-rays from being produced from portions of the cathode.

The present anode sleeve makes possible the production of spectrally pure primary x-ray streams by reducing or eliminating the production of secondary x-ray signals. Inaccuracies created by such contamination in sensitive analysis procedures, such as XRF spectroscopy, are significantly reduced or eliminated. Therefore, the composition of samples subjected to XRF spectroscopy may be determined with greater precision that what was before possible. Additionally, forming the sleeve from beryllium or similar materials avoids the problems associated with outgassing and particle creation encountered with prior art solutions.

These and other objects, features and advantages of the present invention will more fully apparent from the following description and appended claims, or may be by the practice of the invention as set forth hereinafter.

BRIEF DESCRIPTION OF THE DRAWINGS

In order that the manner in which the above recited and other advantages and features of the invention are obtained, a more particular description of the invention briefly described above will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is understood that the drawings are diagrammatic and schematic representations of presently preferred embodiments of the invention, and are not limiting of the present invention nor are they necessarily drawn to scale.

Figure 1:
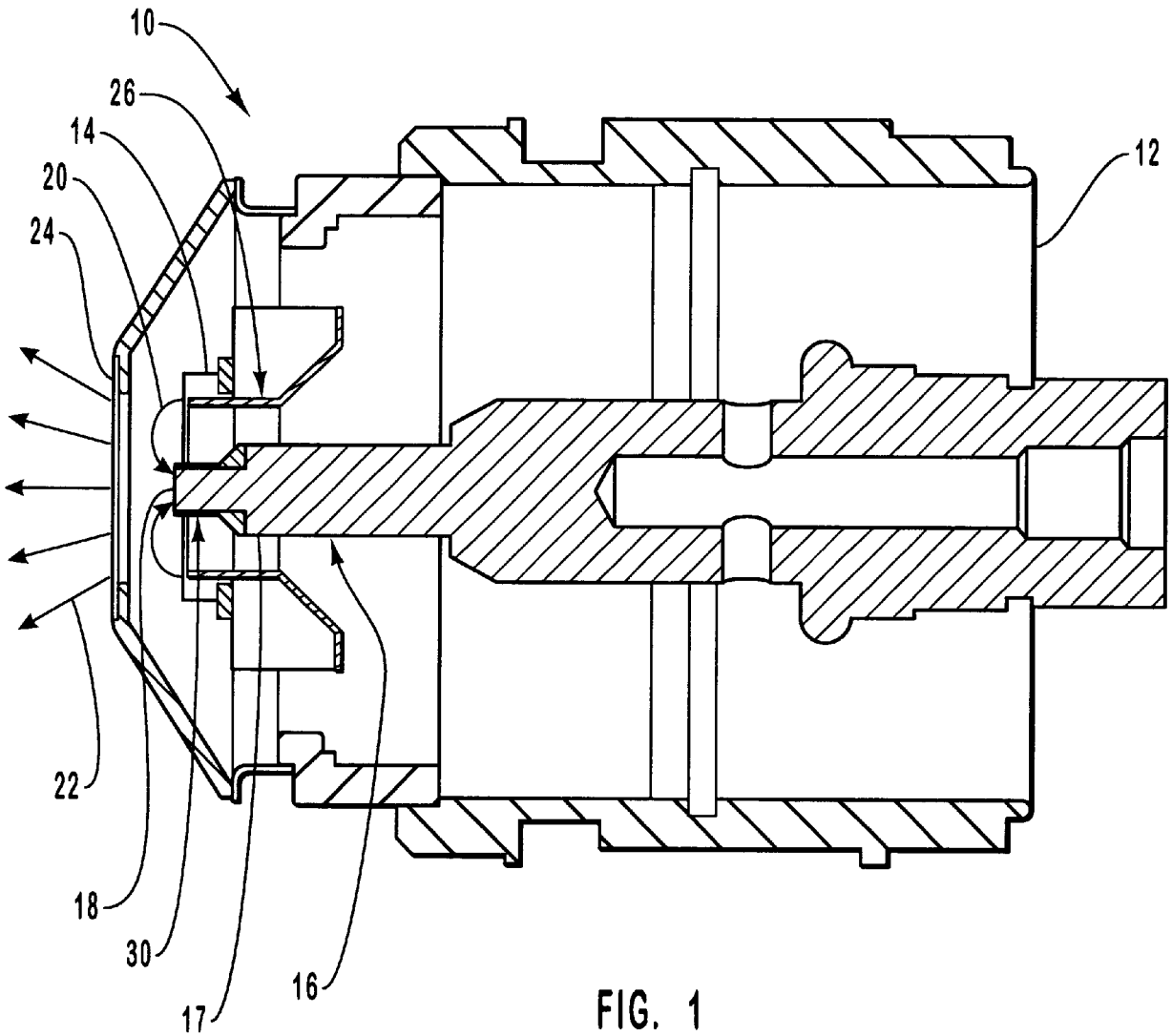
FIG. 1 is a simplified cross-sectional side view of a stationary anode x-ray tube configured with the anode sleeve of the present invention.

Reference is first made to FIG. 1, which depicts one example of an analytical x-ray tube 10 having a stationary anode, such as might be used in XRF spectroscopy applications. The x-ray tube 10 includes an outer housing 12 forming a vacuum enclosure. Disposed within the vacuum enclosure is a cathode structure 14, and a stationary anode structure 16. The anode structure 16 includes an anode substrate 17 and a target surface 18 disposed at one end of the substrate. The target surface preferably comprises a material having a sufficiently high "Z" number, such as rhodium, palladium, tungsten or the like. However, it will be appreciated that various other target surface materials could be used as required to achieve one or more desired results of affects, and depending on the type of analysis to be performed. The anode substrate 17 is formed of a material having a high thermal conductivity, such as copper or a copper alloy. The high thermal conductivity of the substrate 17 facilitates dissipation of at least some of the heat produced at the target surface 18 resulting from the interactions between the electrons 20 and the target surface 18.

In operation, an electrical current is supplied to a filament coil portion of the cathode 14, which causes a beam of electrons (depicted at 20) to be emitted from the cathode 14 by way of thermionic emission. A high voltage potential difference is applied between the cathode 14 and the anode 16, which causes the electrons 20 to accelerate to a high velocity. The electrons 20 possess a large amount of kinetic energy, and when they impinge upon the target surface 18 a portion of some of this kinetic energy is converted to x-rays including the characteristic peaks of the target material. The x-rays are directed through a window 24 defined in the housing 12 as is depicted at 22, and directed towards the specimen being analyzed (not shown). X-ray tubes having windows situated at the end of the vacuum enclosure (as depicted in FIG. 1) are known as end window x-ray tubes, while tubes having windows disposed in the side of the vacuum enclosure are referred to as side window x-ray tubes.

In the illustrated embodiment, a shield 26 is disposed within the vacuum enclosure 12 so as to prevent electrons 20 emitted from the cathode 14 from impacting other interior tube parts before impacting the target surface 18.

As mentioned above, a small percentage of the electrons striking the anode target surface 18 actually stimulate the production of x-rays 22. Many of the electrons merely generate heat at the target surface. Also, a substantial portion of the electrons rebound off of the target surface while retaining a large portion of their original kinetic energy. These back-scattered electrons may strike other areas of the x-ray tube, such as the anode substrate 17 and produce contaminating secondary x-rays—i.e., having wavelengths that differ from that of the primary x-ray signal 22.

With continuing reference to FIG. 1, one embodiment of an anode sleeve 30 is shown. As can be seen in cross section, the anode sleeve 30 is sized and configured to circumferentially fit about at least a portion of the outer surface of the anode substrate 17. As is better shown in FIG. 3, the anode sleeve 30 is formed with a hollow main cylindrical body portion 32 in order to fit over a corresponding cylindrical portion of the anode substrate 17. As is shown, the anode sleeve 30 is preferably disposed about a portion of the substrate 17 adjacent to the target surface 18, where back-scattered electrons are known to impact the substrate. Of course, the anode sleeve 30 could be sized and configured to cover more or less of the anode substrate 17, as discussed further below.

Figure 3:
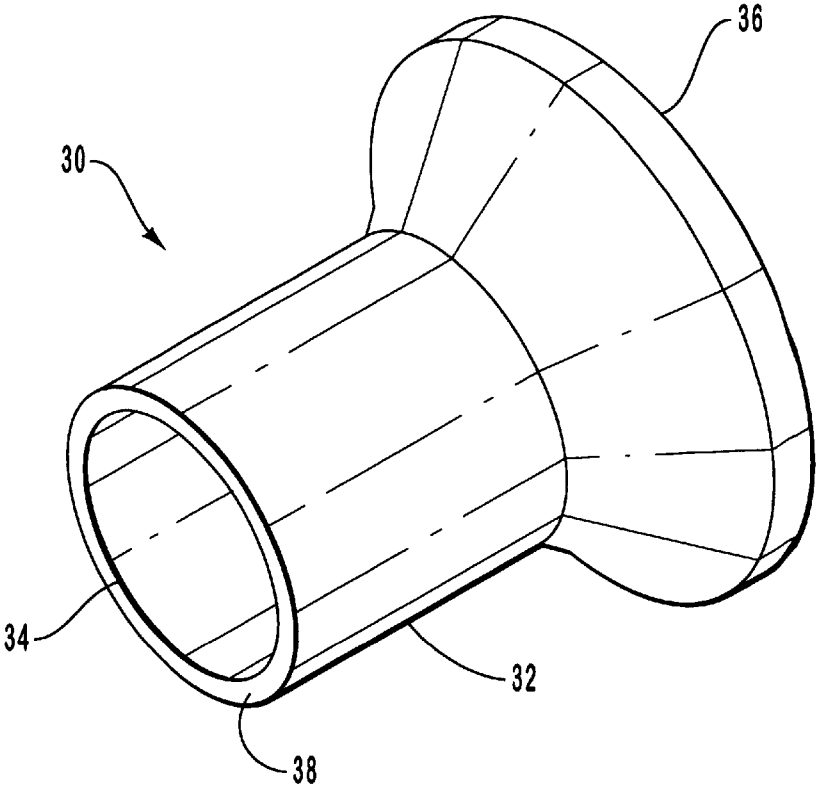
FIG. 3 is a perspective view of the anode sleeve of FIG. 2.
Figure 2:
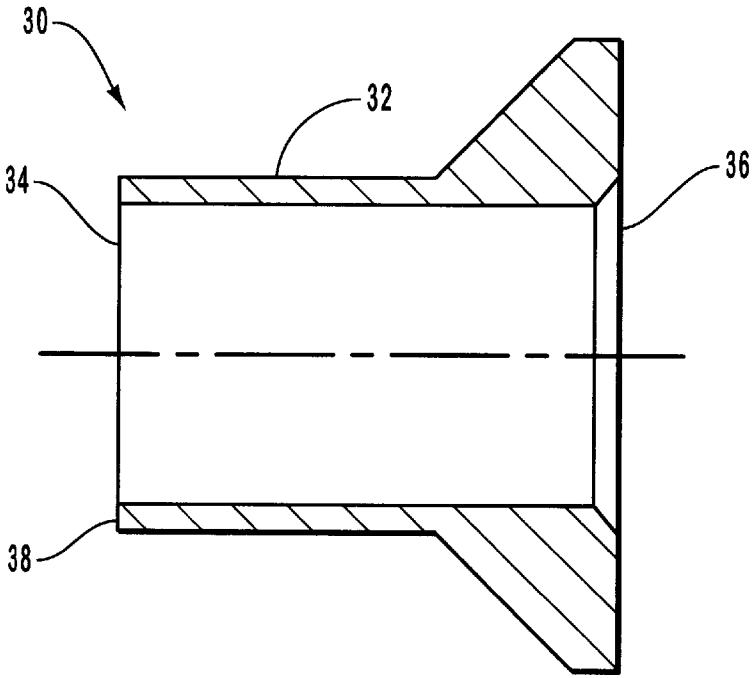
FIG. 2 is a cross-sectional side view of a preferred embodiment of the anode sleeve of the present invention.

Referring now to both FIGS. 2 and 3, the hollow cylindrical body 32 defines an aperture on both a first end 34 and a second end 36. The body 32 near the second end 36 is flared to an increased diameter relative to the first end 34 in order to accommodate the shape of the outer surface of the substrate 17 shown in FIG. 1. It will be appreciated that the sleeve could be implemented with other shapes and configurations.

The outer wall of the hollow cylindrical body 32 is preferably of a sufficient thickness to prevent penetration by back-scattered electrons. Factors that determine the minimum thickness of the wall of the body 32 include the atomic number of the element from which the sleeve is manufactured, and the kinetic energy of the electrons incident upon the surface of the body, which depends on the operating power of the x-ray tube. For example, for the illustrated sleeve 30, when used in a typical XRF spectroscopy application, the thickness may be about 0.01 inches.

The anode sleeve 30 is composed of a material satisfying several requirements. First, the anode sleeve should be composed of a material that does not produce contaminating secondary x-rays as detected by detector instrumentation used in connection with the x-ray tube. The selected material should also be able to withstand the extreme operating temperatures present within an operating x-ray tube, which can exceed temperatures of 700° C. Preferably, the selected material should be amenable to machining or manufacturing processes without creating an increased likelihood for particle creation or flaking after the sleeve is installed on the anode 16. Finally, the material used should have minimal outgassing characteristics once it is disposed within the evacuated housing in the tube.

In regards to the first requirement, the selected material for the anode sleeve 30 should be selected from those substances that produce characteristic x-rays that have wavelengths not within the range of detection of the detector instrumentation used in conjunction with the x-ray tube 10, such as in XRF spectroscopy. Otherwise, the secondary x-rays produced as a result of the interaction between the sleeve and the back-scattered electrons will contaminate the primary stream of x-rays and provide inconclusive results to the detector equipment. Most detector instruments used in conjunction with stationary anode x-ray tubes are designed not to recognize x-rays characteristic of elements with atomic numbers less than approximately 11, such as sodium.

One preferred material for the sleeve 30 is beryllium, which has an atomic number of 4 and is thus out of the designated sensitivity range of most x-ray detector instruments. Any secondary x-rays produced by a sleeve composed of beryllium will not be considered as contaminating to the primary stream of x-rays. Beryllium also meets the other desired characteristics of an anode sleeve material. In particular, it is capable of enduring high temperatures, is easily machinable, and is not susceptible to particle creation or outgassing after installation in, or during the use of, a stationary anode x-ray tube.

Other materials could be used for the anode sleeve. Diamond is an example of such a material. Also, for certain applications it may be desirable to manufacture the anode sleeve from the same material as the anode target material, such as rhodium or palladium. A sleeve composed of the same material as the target surface does not produce contaminating secondary x-rays because any x-rays that are produced are of a frequency that is accounted for by the detector instrumentation used in conjunction with the tube.

The anode sleeve 30 depicted in FIGS. 2 and 3 may be manufactured by known manufacturing processes. One method for manufacturing the preferred anode sleeve 30 includes providing a rod comprising beryllium and machining a portion thereof such that a hollow cylindrical body 32 is formed including a first end 34 having a first diameter and a second end 36 having a second diameter. The first end 34 is defined such that its diameter is sufficient to cooperatively fit about the outer circumference of the target surface 18, while the second end 36 is defined to receive a portion of the anode substrate 17. The machined sleeve 30 is then cleaned to remove any particles before being affixed to the anode 16 by known means, such as brazing. Other attachment schemes could also be used, including use of intermeshing threads, or a detent and nub arrangement disposed on the anode 16 and sleeve 30.

When installed, the first end 34 of the anode sleeve 30 is preferably disposed directly adjacent to the target surface 18 such that a snug fit exists between the outer circumference of the target surface and the inner circumference of the aperture defined in the first end 34 of the sleeve. In this way, any back-scattered electrons that rebound off the target surface 18 may not cause secondary x-ray contamination by infiltrating any spacing that might otherwise exist between the target surface 18 and the sleeve 30 and impacting the anode substrate 17.

During tube operation, the anode sleeve 30 of the present invention advantageously prevents contamination of the primary stream of x-rays emitted by the target surface 18 by reducing or eliminating the production of secondary x-rays by the anode substrate 17. As explained above, many back-scattered electrons do not produce primary x-rays when they impact the target surface 18, but instead rebound. These back-scattered electrons can be re-attracted not only back to the target surface 18, but also to a portion of the anode substrate 17 near the end upon which the target surface is deposited. The anode sleeve 30 is sized to cover this portion of the substrate 17 that would otherwise be impacted by these errant electrons, as shown in FIG. 1. With the sleeve 30 attached, the back-scattered electrons do not impinge the surface of the copper substrate 17, but rather impact the beryllium sleeve. Any secondary x-rays created by the electrons' impact with the beryllium sleeve 30 possess a wavelength characteristic of beryllium which, as explained above, is not recognized by attached detection equipment and is therefore not considered secondary x-ray contamination of the primary x-ray stream. In this way, a spectrally pure primary x-ray stream is produced by the x-ray tube 10, with the stream collectively possessing a continuous spectrum with characteristic peaks of the target.

The anode sleeve 30 is but one example of a means for preventing the production of x-rays by the substrate 17. It should be understood that this structure is presented solely by way of example and should not be construed as limiting the scope of the present invention in any way.

Figure 4:
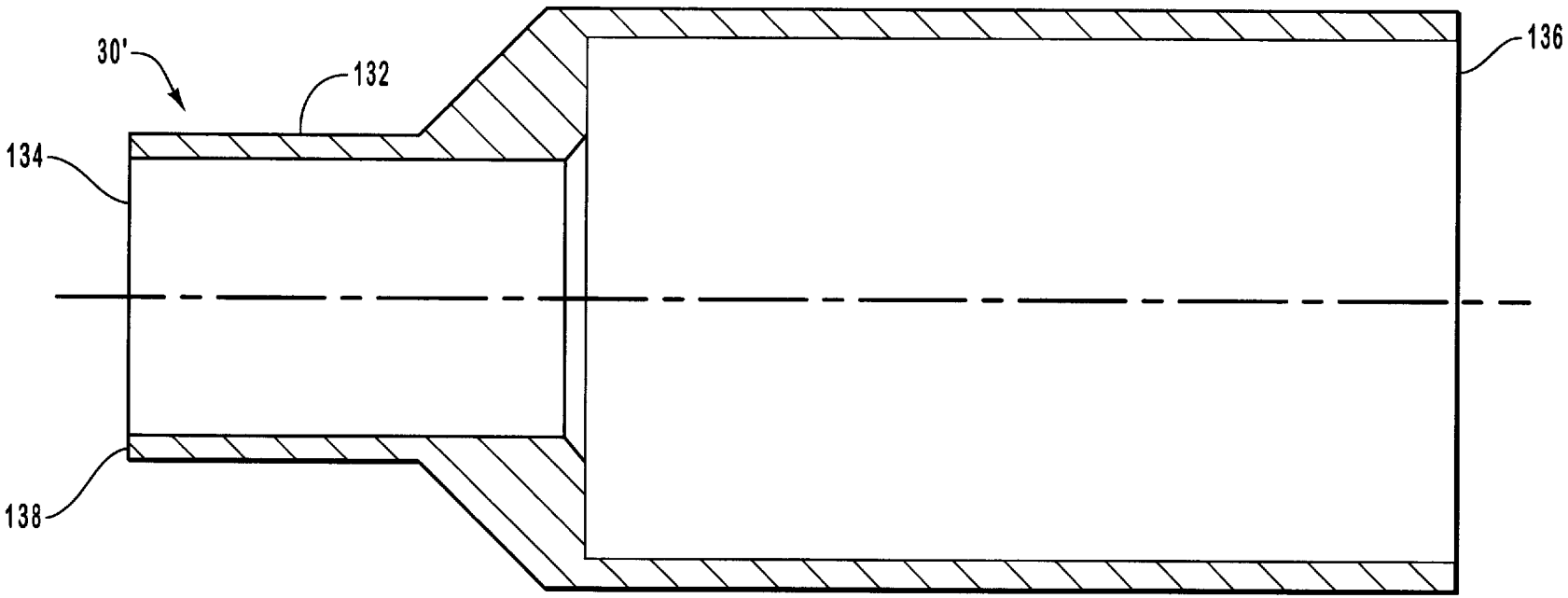
FIG. 4 is a cross-sectional side view of the present anode sleeve in accordance with an alternative embodiment thereof.

FIG. 4 illustrates one alternative embodiment of the anode sleeve, designated generally at 30'. As in the previous embodiment, the anode sleeve 30' comprises a hollow cylindrical body 132 having a first end 134 and a second end 136. The hollow body 32 in this embodiment is manufactured to have a longer length as may desired or needed to suit the particular application with which the sleeve 30' is used. The longer length of the sleeve 30' as depicted in FIG. 4 may be necessary, for example, to cover a greater portion of the anode substrate 17 in order to ensure that no back-scattered electrons impact the substrate. In such a case, the sleeve 30' of this alternative embodiment may define an axial cavity having more than one diameter, as is shown in FIG. 4, in order to cooperatively fit over the outer surface of the anode substrate 17. In fact, the anode sleeve could be sized to any one of a variety of length, thickness, and/or axial cavity dimensional configurations.

Figure 5:
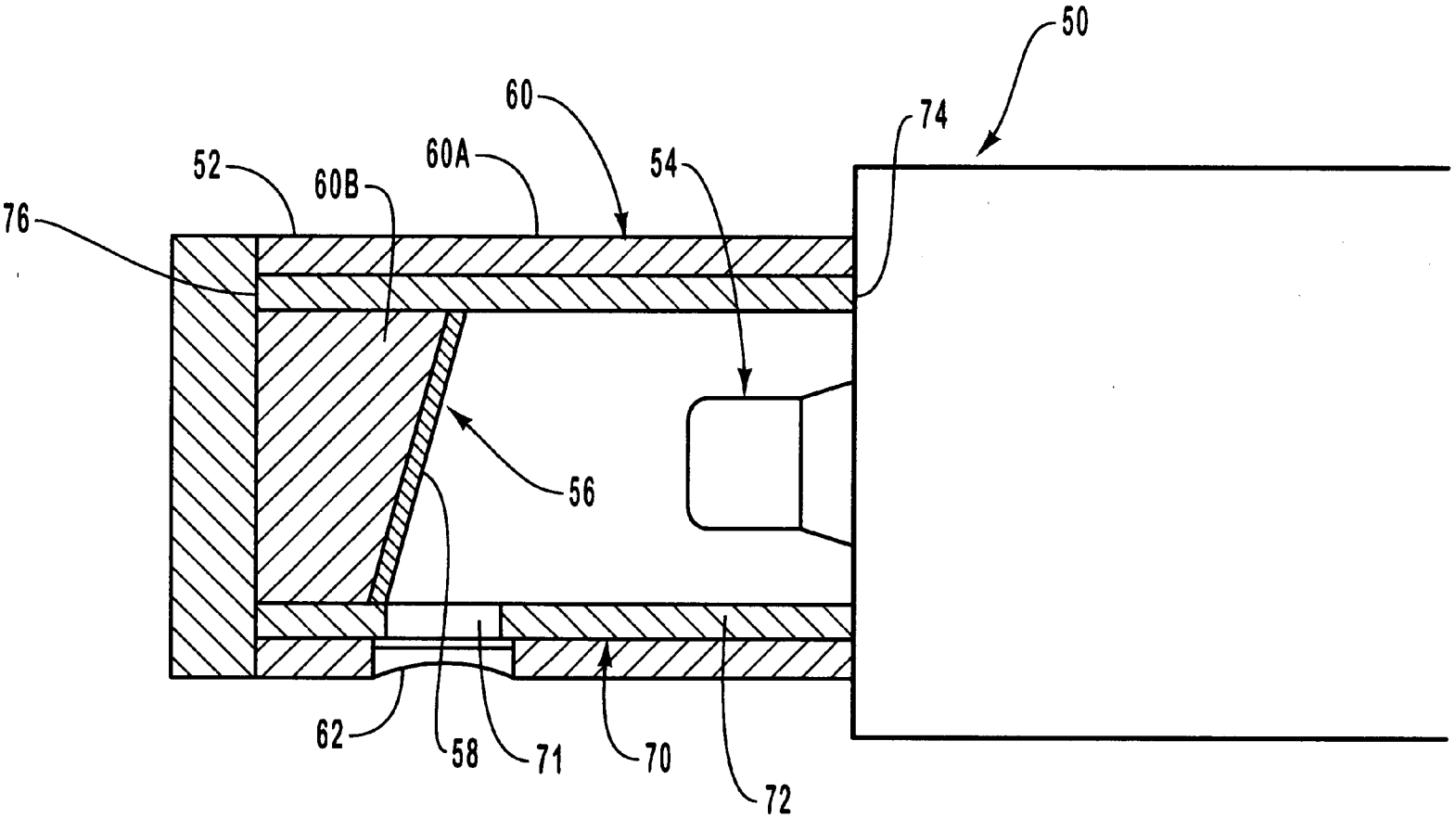
FIG. 5 is a cross-sectional side view of a side-window x-ray tube incorporating an alternative embodiment of the present anode sleeve.

Yet another embodiment of the anode sleeve is depicted in FIG. 5, which illustrates in cross section a side window x-ray tube 50, in contrast to the end-window x-ray tube depicted in FIG. 1. The x-ray tube 50 comprises a housing 52 defining a vacuum enclosure, which has disposed within it a cathode 54 and an anode 56. The anode 56 includes a target surface 58 disposed on a substrate 60. The substrate 60 comprises a hollow cylindrical portion 60A, which also forms part of the vacuum enclosure, and a supporting portion 60B on which is disposed the target surface 58. A window 62 is disposed in the side of the vacuum enclosure 52. An anode sleeve 70 is shown disposed between the inner surface of the hollow cylindrical portion 60A and the outer surface of the supporting portion 60B of the anode substrate 60. In one embodiment, the anode sleeve 70 comprises beryllium and covers that portion of the substrate 60 that is susceptible to impinging back-scattered electrons within the vacuum enclosure 52. The anode sleeve 70 is formed as a hollow cylindrical body 72 of sufficient thickness to prevent the complete penetration of back-scattered electrons therethrough, a first end 74, and a second end 76. A portion of the sleeve has an aperture 71 formed through it to allow x-rays to pass through to the window 62. The anode sleeve 70 covers the desired portions of the substrate 60 without interfering with the production of primary x-rays on the target surface or the emission thereof through the window 62.

The operation of the anode sleeve 70 is similar to that of the anode sleeve 30 installed in the end-window x-ray tube 10. The sleeve 70 covers those portions of the anode substrate 60 that may be impacted by back-scattered electrons. The electrons impact the anode sleeve 70 instead, and non-contaminating x-rays are thus produced. This prevents secondary x-ray contamination of the primary x-ray stream produced by the target surface and increases the performance of the x-ray tube.

An alternative means by which the production of secondary x-rays may be reduced or eliminated within an x-ray tube involves the use of covers disposed over components, other than the anode, that are located within the interior of the vacuum enclosure. Such covers may be desirable to prevent the production of secondary x-rays resulting from the incidence of back-scattered electrons on other non-target components. These covers are preferably composed of beryllium, though other suitable materials could alternatively be used in place of beryllium, as explained above. An example of an intra-tube component that could benefit from such a cover is the shield 26 shown in FIG. 1. This shield 26 (designed to prevent the electrons 20 emitted from the cathode 14 from impacting other interior tube parts before impacting the target surface 18) will emit only non-contaminating secondary x-rays should any back-scattered electrons impinge upon it. In this way, other intra-tube components may be eliminated as sources of secondary x-ray contamination during tube operation, thereby providing superior spectral quality in the primary x-ray stream emitted from the tube.

In summary, the anode sleeve of the present invention enables the production of high quality, spectrally pure primary x-ray emissions free from the contaminating x-rays otherwise produced at the anode substrate. Such x-ray streams allow for more precise measurements by attached detector instrumentation because they are free from x-ray impurities that may provide inclusive results in such applications as specimen analysis in XRF spectroscopy. The utilization of a sleeve that fits over a portion of the anode substrate is easier to install than known substrate plating techniques, and use of beryllium (or similar material) as the sleeve material provides a sleeve that will not suffer from outgassing or particle creation problems.

The present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. An x-ray tube comprising:

a vacuum enclosure including an x-ray transmissive window;

a cathode assembly disposed within the enclosure, the cathode assembly including an electron source capable of emitting electrons;

an anode having a target surface disposed on a substrate portion so that at least some of the emitted electrons impact the target surface and produce primary x-rays having a continuous spectrum with characteristic peaks of a material used in the target surface; and a sleeve disposed along an outer surface of the substrate portion of the anode, the sleeve being comprised of a material that produces secondary x-rays when impinged by electrons, the secondary x-rays having wavelengths that do not interfere with the primary x-rays.

2. An x-ray tube as defined in claim 1, wherein the sleeve is comprised of a material selected from the group consisting of beryllium, rhodium, palladium, and diamond.

3. An x-ray tube as defined in claim 1, wherein the sleeve is disposed about an outer periphery of the substrate portion substantially adjacent to the target surface.

4. An x-ray tube as defined in claim 1, wherein the anode is a stationary anode.

5. An x-ray tube as defined in claim 1, wherein at least a portion of the substrate portion of the stationary anode is received within an axial cavity formed through the sleeve.

6. An x-ray tube as defined in claim 1, wherein the anode substrate portion comprises copper.

7. An x-ray tube as defined in claim 1, wherein the target surface is selected from the group consisting of rhodium and palladium.

8. In an x-ray tube capable of emitting primary x-ray signals having a predetermined wavelength by impinging electrons on an anode target surface, a method for reducing the emission of secondary x-ray signals from the x-ray tube that interfere with the primary x-ray signals, the method comprising the steps of:

providing a mass of material having an atomic number such that the material, when impinged with electrons, produces an x-ray signal having a wavelength that does not interfere with the primary x-ray signal;

forming from the mass a sleeve having an outer wall with a predetermined thickness; and positioning the sleeve along an outer surface of the anode that is susceptible to impingement by electrons rebounding from the anode target surface.

9. A method for reducing the emission of secondary x-ray signals as defined in claim 8, wherein the material is selected from the group consisting of beryllium, rhodium, palladium, and diamond.

10. A method for reducing the emission of secondary x-ray signals as defined in claim 8, further comprising the step of:

cleaning the sleeve prior to positioning the sleeve on the anode so as to prevent contamination of the x-ray tube.

11. An anode sleeve for use with a stationary anode in an x-ray tube, the anode sleeve comprising:

a cylindrical portion comprising beryllium as a major component and having a first end, a second end, and an axial cavity extending from the first end to the second end, the axial cavity sized to receive therein at least a portion of an outer surface of the stationary anode.

12. An anode sleeve as defined in claim 11, wherein the anode sleeve comprises a part of a stationary anode x-ray tube having an x-ray transmissive window disposed therein.

13. An anode sleeve as defined in claim 12, wherein the first end of the cylindrical portion is disposed adjacent to a target surface disposed on the substrate of the stationary anode.

14. An anode sleeve as defined in claim 13, wherein the sleeve is brazed to the at least a portion of the stationary anode substrate received therein.

15. An x-ray tube comprising:

a vacuum enclosure including an x-ray transmissive window;

a cathode assembly disposed within the enclosure, the cathode assembly including an electron source capable of emitting electrons;

a stationary anode having a target surface disposed on a substrate portion so that at least some of the emitted electrons impact the target surface and produce a primary x-ray signal having a predetermined wavelength; and a cover affixed to a portion of an outer surface of the substrate portion of the anode that is susceptible to impingement by electrons rebounding from the anode target surface, the cover being comprised of a material having an atomic number such that the cover, when impinged with rebounding electrons, produces an x-ray signal having a wavelength that does not interfere with the primary x-ray signal.

16. An x-ray tube as defined in claim 15, wherein the cover material is selected from the group consisting of beryllium, rhokium, pallakium and diamond.

17. A stationary anode x-ray tube, comprising:

a vacuum enclosure including an x-ray transmissive window;

a cathode assembly disposed within the vacuum enclosure, the cathode assembly including an electron source capable of emitting electrons;

a stationary anode disposed within the vacuum enclosure, the stationary anode including a substrate and a target surface that is positioned on the substrate to receive at least some of the electrons emitted by the electron source and produce x-rays; and a sleeve affixed to at least a portion of an outer surface of the substrate of the stationary anode and positioned to substantially prevent electrons that are back-scattered from the target surface from impacting the substrate, the sleeve being composed of beryllium.

18. A stationary anode x-ray tube as defined in claim 17, wherein the sleeve and the target surface substantially cover the entire outer surface of the substrate portion that is disposed within the vacuum enclosure.

19. A stationary anode x-ray tube, comprising:

a vacuum enclosure including an x-ray transmissive window;

a cathode assembly disposed within the vacuum enclosure, the cathode assembly including an electron source capable of emitting electrons;

a stationary anode disposed within the vacuum enclosure, the stationary anode including a substrate and a target surface positioned on the substrate to receive at least some of the electrons emitted by the electron source and produce primary x-rays having at least one characteristic wavelength; and a sleeve affixed to at least a portion of an outer surface of the substrate of the stationary anode, the sleeve comprised of a material that produces secondary x-rays having at least one characteristic wavelength when the sleeve is impinged by electrons that are back-scattered from the target surface, the at least one characteristic wavelength of the secondary x-rays being within a range of wavelengths that is not detected by a detector that receives both the primary and secondary x-rays.

20. A stationary anode x-ray tube as defined in claim 18, wherein the range of wavelengths is defined by the characteristic wavelengths of x-rays produced by elements having atomic numbers less than 11.

21. A stationary anode x-ray tube as defined in claim 18, wherein the sleeve is comprised of beryllium.

22. An anode sleeve for use with a stationary anode in an x-ray tube, the anode sleeve comprising:

a cylindrical portion having a first end, a second end, and an axial cavity extending from the first end to the second end, the axial cavity sized to receive therein at least a portion of an outter surface of the stationary anode.

23. An anode sleeve as defined in claim 22, wherein the cylindrical portion comprises beryllium.

* * * * *

UNITED STATES PATENT AND TRADEMARK OFFICE

CERTIFICATE OF CORRECTION

PATENT NO. : 6,690,765 B1
DATED : February 10, 2004
INVENTOR(S) : Robert Steven Miller It is certified that error appears in the above-identified patent and that said Letters Patent is hereby corrected as shown below:

Column 5,
Line 12, remove thre words "some of"

Column 7,
Line 42, change "as may desired" to -- as may be desired --

Column 10,
Line 34, change "pallakium" to -- palladium --
Line 34, change "rhokium" to -- rhodium --

Column 11,
Line 10, change "Claim 18" to -- Claim 19 --

Column 12,
Line 1, change "Claim 18" to -- Claim 19 --
Line 8, change "outter" to -- outer --

Signed and Sealed this

Sixteenth Day of November, 2004

JON W. DUDAS
*Director of the United States Patent and Trademark Office*